United States Patent [19]

McIntyre et al.

[11] 4,391,856

[45] Jul. 5, 1983

[54] ADHESIVE APPLICATOR AND METHOD FOR CIGARETTE-TO-FILTER ADHESION AND SIMILAR APPLICATIONS

[75] Inventors: Donald B. McIntyre; Frederic S. McIntyre, both of Wellesley, Mass.

[73] Assignee: Acumeter Laboratories, Inc., Marlborough, Mass.

[21] Appl. No.: 198,616

[22] Filed: Oct. 20, 1980

Related U.S. Application Data

[62] Division of Ser. No. 69,972, Aug. 27, 1979, abandoned.

[51] Int. Cl.³ ..... B05D 1/26

[52] U.S. Cl. ..... 427/358; 427/285; 427/286; 118/56; 118/126; 118/253

[58] Field of Search ..... 118/56, 411, 410, 412, 118/415, 253, 247, 123, 124, 126; 427/285, 286, 358; 131/29, 24, 69

[56] References Cited

U.S. PATENT DOCUMENTS

| | | | |
|---|---|---|---|
| 2,833,242 | 5/1958 | Neidich et al. | 118/412 |
| 3,556,832 | 1/1971 | Park | 427/355 |
| 4,142,010 | 2/1979 | Pipkin | 427/355 |

*Primary Examiner*—Shrive P. Beck

*Attorney, Agent, or Firm*—Rines and Rines, Shapiro and Shapiro

[57] ABSTRACT

This disclosure is concerned with enabling the use of multiple liquid adhesive nozzles principally to provide continuous uniform adhesive layers, particularly in relatively small items such as cigarette filter tips or the like, wherein a critically oriented adhesive shear surface adjacent the nozzles causes the plurality of adhesive beads simultaneously deposited by the nozzles to merge into a full, continuous, uniform coating, and with additional control features provided to control the degree of merger from separate adjacent beads to uniform merged coating.

1 Claim, 4 Drawing Figures

ADHESIVE APPLICATOR AND METHOD FOR CIGARETTE-TO-FILTER ADHESION AND SIMILAR APPLICATIONS

This is a divisional application of Ser. No. 069,972, filed Aug. 27, 1979 and now abandoned.

The present invention relates to liquid adhesive applicators, being more particularly concerned with such applicators, and methods of using the same, for providing continuous adhesive coatings on items such as cigarette filter tip papers and the like, with the aid of multiple, small nozzles through which suitable adhesive materials are pumped simultaneously to generate a plurality of parallel fine beads of adhesive upon a continuous web of such papers or the like, with the invention providing for the controlled merging of such beads into a required full, uniform and continuous coating, with control of the degree of merging when desired.

In our earlier U.S. Pat. Nos. 3,595,204; 3,323,510 and 3,174,689, highly successful hot-melt and cold adhesive applicators are described for enabling the application of a wide variety of configurations of adhesive lines, dots, bands, etc. to continuous paper or other webs drawn past appropriate nozzles through which the adhesive (or other fluid) is pumped in a controlled manner. There are occasions, however, particularly where delicate attachments are involved as, for example, in applying filter tip papers to cigarettes, that high-speed, very uniform and continuous coating layers are required throughout the paper, even though a plurality of closely spaced, small nozzles is needed to effect the required depositions. Such nozzles, of course, are limited in the fineness of their orifices by pumping and clogging considerations and the like, and they generate beads of adhesive, not a flat, continuous, uniform coating.

It is primarily to the solution of this problem of developing such a continuous, uniform coating from a plurality of fine, parallel nozzle beads of adhesive, and at high speeds of continuous operation, that the present invention is directed, it being an object of the invention to provide a new and improved adhesive applicator of the multi-nozzle type, and method of operating the same, to effect such continuous coatings for such applications as cigarette-to-filter adhesion and the like.

A further object is to provide such a novel applicator and method with positive control over the degree of merger of the multiple beads of adhesive extruded from the plurality of adjacent nozzle orifices.

An additional object is to provide an improved multi-nozzle fluid applicator of more general utility, as well.

Other and further objects will be explained hereinafter and are more particularly delineated in the appended claims. In summary, however, from one of its important aspects, the invention embraces a fluid adhesive applicator and the like, having, in combination, a plurality of fine-orifice closely spaced nozzles disposed in a plane extending transversely of a predetermined region; pumping means for simultaneously supplying the nozzles with the fluid adhesive; means for drawing a web of material-to-be-coated longitudinally through said predetermined region in juxtaposition to the orifices of said nozzles simultaneously to receive therefrom a corresponding plurality of closely spaced beads of adhesive upon the web and extending transversely across said web; edge means formed by a recess extending inward from said plane and web a short distance longitudinally beyond said orifices; and means for directing the drawing of said web to shear the web against said edge means at an acute angle to said plane, with said directing means and said angle being adjusted relative to the number and fineness of said orifices to cause said parallel beads of adhesive to merge into a continuous, uniform, full coating extending transversely across said web. Preferred operating steps and controls, and best mode constructional details are hereinafter presented.

The invention will now be described with reference to the accompanying drawings, FIG. 1 of which is a combined schematic and isometric view of a preferred embodiment of the invention, shown applied to the illustrative application of adhesive layers upon cigarette filter tipping paper and the like;

Figure 1:
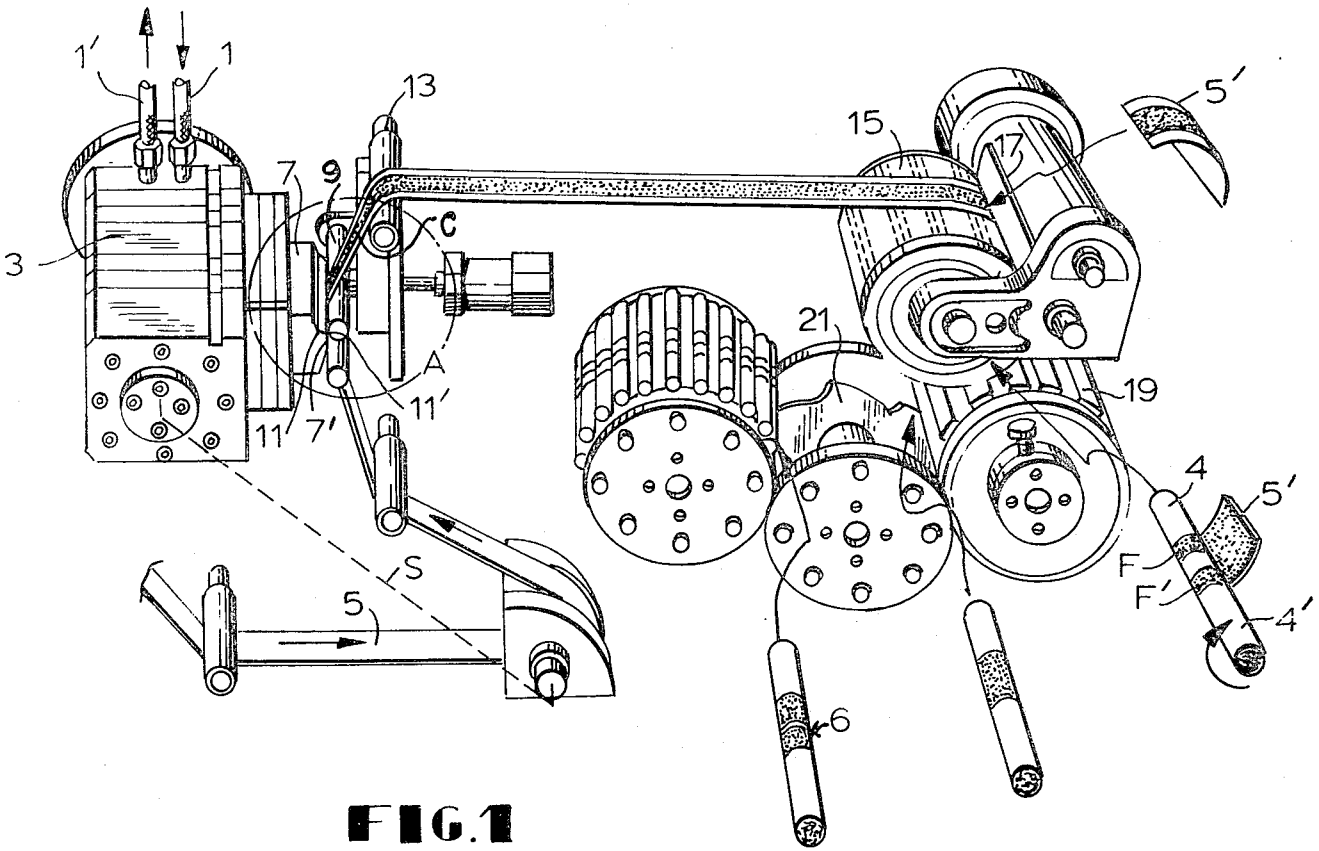
Figure 4:
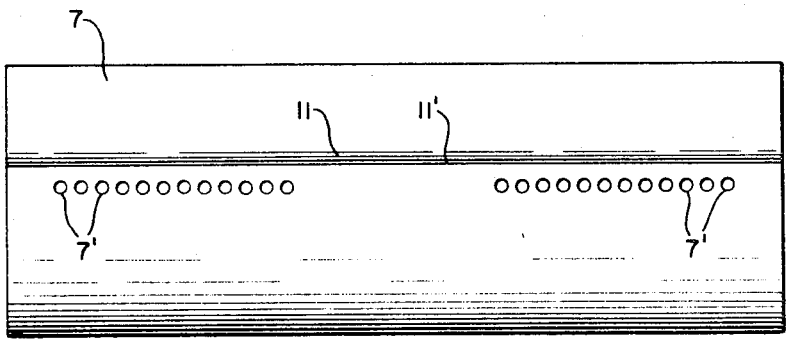
FIG. 4 is a side elevation view of a novel dispensing head in accordance with the invention.

Referring to FIG. 1, fluid adhesive from a reservoir R is fed along a supply line 1 into a positive displacement gear metering pump 3, driven synchronously by a direct machine drive, schematically illustrated at S, which also drives the paper or other web 5, such as the exemplary cigarette filter tipping paper web. Suitable metering pumps of this character are described in said Letters Patent and elsewhere, and include for example, the Acumeter (Newton Lower Falls, Mass.) Models 1BUP2, 1BUP4 and 1BUP24 of the assignee of the present invention. The latter model will pump 0.6 cc per ½ revolution input per nozzle discharge. Appropriate cold adhesives for normal cigarette filter tipping applications and the like are polyvinyl acetate resin emulsions, such as HR Fuller No. 1503 and Swift & Co. No. 2802 AX. The metering pump 3 therefor, is shown applying the fluid to a novel dispensing head 7 (see FIG. 4), having a transverse line of a plurality of relatively small coplanar nozzle discharge or extrusion orifices 7' through which the adhesive is simultaneously extruded as a corresponding plurality of beads in response to the metered pumping. The return line from the pump 3 to the reservoir R is shown at 1'.

Figure 2:
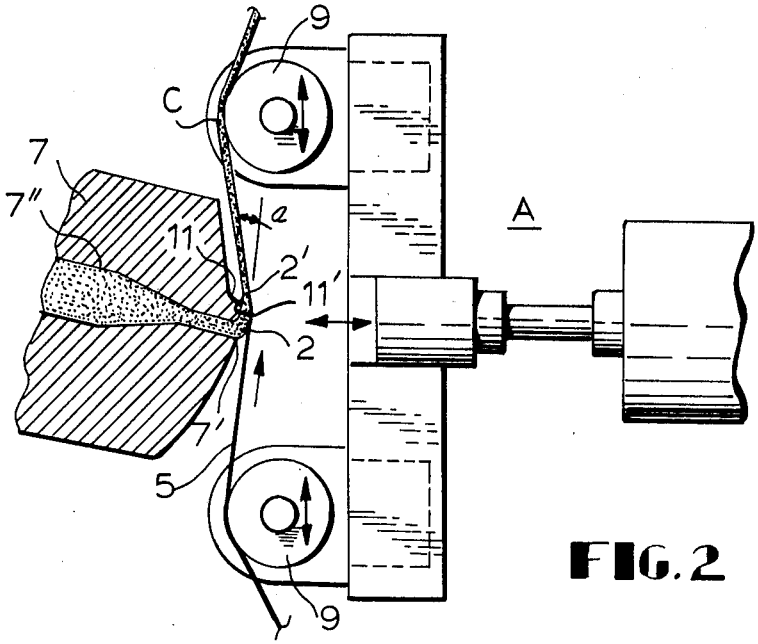
FIG. 2 is a view, upon an expanded scale, partly longitudinally sectionalized, of the nozzle extruding and shearing section A of FIG. 1.

In accordance with the present invention, the transverse line of orifices 7', one of which is more particularly shown in FIG. 2 as each preceded by a converging extrusion nozzle section 7" within the head 7, is oriented substantially parallel or at a slight angle to the paper or other web 5, drawn longitudinally upwardly past the same between web support bars 9. The bars 9 may be adjustable, as illustrated, to retract at machine shutdown to bring the web away from the nozzle head 7. The extrusion head or nozzle 7 is provided within a short distance beyond the plane of the orifices 7' upward in the direction of web travel, say within a thirty-second an inch or so, with an L-shaped recess 11 defining a shearing edge 11' over which the juxtaposed web 5 is drawn under tension at an acute angle "a" with respect to the direction of the web travel at the predetermined region of the orifice 7' in order to effect a positively directed shearing action upon the transverse line of adhesive beads 2, FIG. 2, extruded upon the web 5 at the orifices 7'. With appropriate dimensions relative to the number and fineness of orifices 7', tension of the web 5 and angle a, it has been found that such a plurality of separate extruded adhesive beads becomes shearingly merged at 2′ into a full or continuous and uniform adhesive coating C upon the web 5.

The coated web 5 continues over roll 13 to and over a vacuum drum 15 where the coated paper is cut into sections, schematically shown at 5′, by a rotary knife cylinder 17. The cut sections 5′ of coated paper, which are to serve as the filter tip paper, are carried down to an adjacent cigarette-carrying drum 19 such that the cut filter paper section 5′ will wrap around the two butted filters F and F′ of the double cigarettes 4–4′, the same being slit at 6 by a intermediate cutting knife 21 to provide a severed pair of cigarettes, as described in our further U.S. Pat. No. 4,090,520 and as is well-known, each having filter tip paper applied to its filter and secured thereto by the adhesive coatings of the invention. In order to avoid the knife 21 becoming contaminated with adhesive, moreover, the plurality of transversely aligned orifices 7′ may be separated into two groups so that the coating C comprises two spaced coated portions, with the spacing centrally disposed to align with the cutter 21.

As an operational example, lines speeds of the order of 80 meters per minute have been obtained with two sets of adjacent nozzle orifices 7′, a dozen orifices in each set and each of the order of 2 mm. orifice diameter, spaced about 2 mm. apart, and with tension over the shearing edge 11′, at an acute angle a of about 25 degrees, of the order of 2 pounds per inch of web width, using cigarette filter paper of the simulated cork paper type, about 0.5 mm. thick. The family of polyvinyl acetate adhesives used have an approximate elongation ratio of 1000 to 2000%, thus permitting the spreading of the adhesive to a very finite and controlled coating film thickness.

Figure 3:
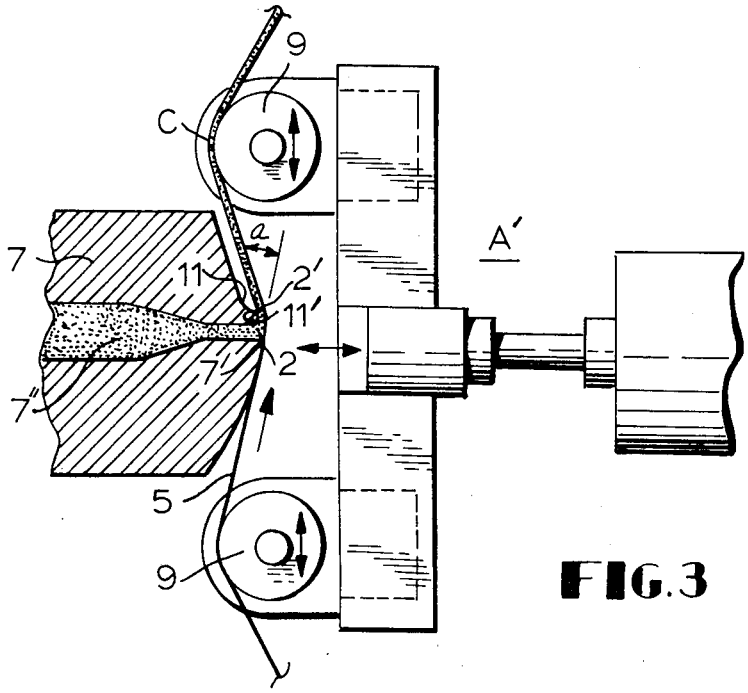
FIG. 3 is a view similar to FIG. 2 of a modified nozzle extruding and shearing section A'.

While in the embodiment of FIGS. 1 and 2, the adhesive is extruded with the nozzle orifices 7′ slightly separated from the web 5 drawn thereby, there are circumstances where it may be desirable for the orifices substantially to touch, and be wiped by the web 5, as more particularly shown in FIG. 3. This can be effected with the more horizontally oriented and closer position of the orifice plane; but with the same immediately subsequent type of shearing action being effected at the recess shear edge 11′.

Through adjustment of such orientation, orifice dimensions and spacing, web tension and angle a, coupled with the before-described synchronous adhesive metering and web line speed, a high degree of control can readily be effected upon the degree of multiple adhesive bead merging or smearing and coating extent, uniformity and thickness.

A further feature of this invention, as distinguished from prior gravure adhesive applicators, and the like, resides in the obviating of the problem of adjusting the adhesive properties to enable a desired compromise between tack and adhesion in view of the very different properties of the dissimilar material multi-elements of the cigarette and, for example, the acetate adhesive. The invention, on the contrary, enables any adhesive property variation to be effected for any desired result in view of the inherent nature of the extrusion and shearing process thereof.

While the invention has been described in connection with the utilization of cold adhesives, furthermore, which are preferred for the above utilization, it is to be understood that the method and apparatus of the invention are also useful with hot-melt adhesives and other fluids wherein performance analagous thereto may be desired. In the event that radiation-curing may in some cases be required for the adhesive, moreover, it is evident that such subsequent curing may also be employable with the system of the invention. Clearly, of course, the technique is applicable with other articles than the illustrative cigarettes filter application; and further modifications will occur to those skilled in this art, such being considered to fall within the spirit and scope of the invention as defined in the appended claims.

What is claimed is:

1. A method of fluid adhesive application, that comprises, depositing at a predetermined region a plurality of inline closely transversely spaced, non-overlapping parallel beads of such adhesive upon a web while drawing the web longitudinally through said region; deflecting the parallel-bead-coated web upward at an acute angle over an edge just beyond the region of bead deposition; and controlling the size of the beads and degree of upward deflection relative to the speed of drawing of the web to shear the beads at said edge and merge the same into a uniform, continuous, full adhesive coating transversely across said web.

* * * * *